US012383114B2

(12) United States Patent
Park et al.

(10) Patent No.: US 12,383,114 B2
(45) Date of Patent: Aug. 12, 2025

(54) DISH WASHER

(71) Applicant: Samsung Electronics Co., Ltd., Suwon-si (KR)

(72) Inventors: Kitae Park, Suwon-si (KR); Jusik Kim, Suwon-si (KR); Daeseon Yeom, Suwon-si (KR); Junho Lee, Suwon-si (KR); Minho Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 266 days.

(21) Appl. No.: 17/819,974

(22) Filed: Aug. 16, 2022

(65) Prior Publication Data

US 2022/0386847 A1 Dec. 8, 2022

Related U.S. Application Data

(63) Continuation of application No. PCT/KR2021/095087, filed on Oct. 25, 2021.

(30) Foreign Application Priority Data

Oct. 28, 2020 (KR) ..... 10-2020-0140973

(51) Int. Cl.
*A47L 15/50* (2006.01)
*A47L 15/42* (2006.01)

(52) U.S. Cl.
CPC ..... *A47L 15/503* (2013.01); *A47L 15/4278* (2013.01); *A47L 15/504* (2013.01)

(58) Field of Classification Search
CPC ... A47L 15/503; A47L 15/4278; A47L 15/504
USPC ..... 134/199
See application file for complete search history.

(56) References Cited

U.S. PATENT DOCUMENTS

| | | | |
|---|---|---|---|
| 4,998,678 | A | 3/1991 | Durr |
| 5,244,129 | A | 9/1993 | Poussin et al. |
| 5,984,826 | A | 11/1999 | Nakano |
| 6,113,119 | A | 9/2000 | Laurent et al. |
| 6,409,456 | B1 | 6/2002 | Horejsi et al. |
| 6,938,627 | B2 | 9/2005 | Jung et al. |
| 6,990,828 | B2 | 1/2006 | Kim et al. |
| 7,228,817 | B2 | 6/2007 | Busse |
| 7,644,826 | B2 | 1/2010 | Koch et al. |

(Continued)

FOREIGN PATENT DOCUMENTS

| | | | |
|---|---|---|---|
| CN | 1042670 | A | 6/1990 |
| CN | 1061940 | A | 6/1992 |

(Continued)

OTHER PUBLICATIONS

CN108245109A—machine translation (Year: 2018).*

(Continued)

*Primary Examiner* — Tinsae B Ayalew

(57) ABSTRACT

A dishwasher is disclosed. The dishwasher includes a main body provided a washing tub inside, a first basket disposed inside the washing tub and configured to accommodate an object to be washed, and a second basket configured to accommodate the object to be washed, and move in a vertical direction between a first position disposed in a partial area inside the first basket, and a second position disposed above the partial area spaced apart from the first basket.

19 Claims, 11 Drawing Sheets

(56) References Cited

U.S. PATENT DOCUMENTS

| | | | |
|---|---|---|---|
| 8,671,712 | B2 | 3/2014 | Noel et al. |
| 8,783,170 | B2 | 7/2014 | Mathey et al. |
| 8,876,984 | B2 | 11/2014 | Hong et al. |
| 8,926,232 | B2 | 1/2015 | Sjoo |
| 9,420,882 | B2 | 8/2016 | Garcia et al. |
| 9,895,018 | B2 | 2/2018 | Lin |
| 9,936,851 | B2 | 4/2018 | Kim et al. |
| 10,413,947 | B2 | 9/2019 | Borghi et al. |
| 10,512,359 | B2 | 12/2019 | Xu et al. |
| 11,419,479 | B2 | 8/2022 | Kim et al. |
| 2005/0133072 | A1 | 6/2005 | Yoon et al. |
| 2020/0281441 | A1 | 9/2020 | Kim et al. |

FOREIGN PATENT DOCUMENTS

| | | | |
|---|---|---|---|
| CN | 1100195 | A | 3/1995 |
| CN | 1122892 | A | 5/1996 |
| CN | 1161481 | A | 10/1997 |
| CN | 1197506 | A | 10/1998 |
| CN | 1466931 | A | 1/2004 |
| CN | 1492208 | A | 4/2004 |
| CN | 1541060 | A | 10/2004 |
| CN | 1628597 | A | 6/2005 |
| CN | 101006833 | A | 8/2007 |
| CN | 102697436 | A | 10/2012 |
| CN | 102730189 | A | 10/2012 |
| CN | 102756625 | A | 10/2012 |
| CN | 102783307 | A | 11/2012 |
| CN | 102837078 | A | 12/2012 |
| CN | 103126515 | A | 6/2013 |
| CN | 103168606 | A | 6/2013 |
| CN | 103174310 | A | 6/2013 |
| CN | 103315525 | A | 9/2013 |
| CN | 103330337 | A | 10/2013 |
| CN | 103462574 | A | 12/2013 |
| CN | 103519568 | A | 1/2014 |
| CN | 103548632 | A | 2/2014 |
| CN | 103598807 | A | 2/2014 |
| CN | 103625869 | A | 3/2014 |
| CN | 103653838 | A | 3/2014 |
| CN | 103654205 | A | 3/2014 |
| CN | 103654666 | A | 3/2014 |
| CN | 103654673 | A | 3/2014 |
| CN | 103654677 | A | 3/2014 |
| CN | 103696845 | A | 4/2014 |
| CN | 103758184 | A | 4/2014 |
| CN | 104033324 | A | 9/2014 |
| CN | 104096673 | A | 10/2014 |
| CN | 104188054 | A | 12/2014 |
| CN | 104264749 | A | 1/2015 |
| CN | 104274064 | A | 1/2015 |
| CN | 104444014 | A | 3/2015 |
| CN | 104464086 | A | 3/2015 |
| CN | 104608415 | A | 5/2015 |
| CN | 104719096 | A | 6/2015 |
| CN | 104719097 | A | 6/2015 |
| CN | 104739139 | A | 7/2015 |
| CN | 104739223 | A | 7/2015 |
| CN | 104757922 | A | 7/2015 |
| CN | 104782257 | A | 7/2015 |
| CN | 104791793 | A | 7/2015 |
| CN | 104798471 | A | 7/2015 |
| CN | 104858643 | A | 8/2015 |
| CN | 104889691 | A | 9/2015 |
| CN | 104889729 | A | 9/2015 |
| CN | 105011734 | A | 11/2015 |
| CN | 105052330 | A | 11/2015 |
| CN | 105054885 | A | 11/2015 |
| CN | 105057731 | A | 11/2015 |
| CN | 105147050 | A | 12/2015 |
| CN | 105193569 | A | 12/2015 |
| CN | 105340438 | A | 2/2016 |
| CN | 105496177 | A | 4/2016 |
| CN | 105534462 | A | 5/2016 |
| CN | 105615808 | A | 6/2016 |
| CN | 105691779 | A | 6/2016 |
| CN | 105794354 | A | 7/2016 |
| CN | 105855896 | A | 8/2016 |
| CN | 105904147 | A | 8/2016 |
| CN | 105909834 | A | 8/2016 |
| CN | 105942951 | A | 9/2016 |
| CN | 105996951 | A | 10/2016 |
| CN | 106002162 | A | 10/2016 |
| CN | 106090807 | A | 11/2016 |
| CN | 106100564 | A | 11/2016 |
| CN | 106108821 | A | 11/2016 |
| CN | 106333591 | A | 1/2017 |
| CN | 106377214 | A | 2/2017 |
| CN | 106495055 | A | 3/2017 |
| CN | 106736510 | A | 5/2017 |
| CN | 106742533 | A | 5/2017 |
| CN | 106799575 | A | 6/2017 |
| CN | 106877539 | A | 6/2017 |
| CN | 106964552 | A | 7/2017 |
| CN | 106965838 | A | 7/2017 |
| CN | 107028346 | A | 8/2017 |
| CN | 107088639 | A | 8/2017 |
| CN | 107095531 | A | 8/2017 |
| CN | 107198355 | A | 9/2017 |
| CN | 107338709 | A | 11/2017 |
| CN | 107351296 | A | 11/2017 |
| CN | 107363175 | A | 11/2017 |
| CN | 107393744 | A | 11/2017 |
| CN | 107440532 | A | 12/2017 |
| CN | 107554840 | A | 1/2018 |
| CN | 107745254 | A | 3/2018 |
| CN | 107822480 | A | 3/2018 |
| CN | 108245109 | A | 7/2018 |
| CN | 108354317 | A | 8/2018 |
| CN | 208693222 | U | 4/2019 |
| CN | 209285437 | U | 8/2019 |
| CN | 209404716 | U | 9/2019 |
| EP | 0688147 | B1 | 3/2002 |
| EP | 0878332 | B1 | 7/2002 |
| EP | 1152681 | B1 | 9/2003 |
| EP | 1488730 | B1 | 3/2009 |
| EP | 2074925 | A1 | 7/2009 |
| EP | 2671494 | B1 | 3/2016 |
| EP | 2890271 | B1 | 10/2016 |
| EP | 1922965 | B1 | 8/2018 |
| EP | 3137587 | B1 | 9/2018 |
| GB | 2282216 | A | 3/1995 |
| JP | H11-342098 | A | 12/1999 |
| JP | 2004-351082 | A | 12/2004 |
| JP | 2006-000189 | A | 1/2006 |
| JP | 2008-125702 | A | 6/2008 |
| KR | 10-0165042 | B1 | 5/1999 |
| KR | 20-0386333 | Y1 | 6/2005 |
| KR | 10-0707556 | B1 | 4/2007 |
| KR | 10-2010-0037460 | A | 4/2010 |
| KR | 10-1088313 | B1 | 11/2011 |
| KR | 10-2020-0107102 | A | 9/2020 |
| KR | 10-2022-0005346 | A | 1/2022 |
| WO | 2017176286 | A1 | 10/2017 |

OTHER PUBLICATIONS

KR0165042B1—machine translation (Year: 1999).*
JP2008125702A—machine translation (Year: 2008).*
International Search Report and Written Opinion of the International Searching Authority dated Jan. 26, 2022, in connection with International Application No. PCT/KR2021/095087, 21 pages.
Supplementary European Search Report dated Nov. 28, 2023, in connection with European Patent Application No. 21886989.9, 10 pages.

* cited by examiner

DISH WASHER

CROSS-REFERENCE TO RELATED APPLICATIONS

This application is a bypass continuation of International Application No. PCT/KR2021/095087, filed Oct. 25, 2021, which claims priority to Korean Patent Application No. 10-2020-0140973, filed Oct. 28, 2020, the disclosures of which are herein incorporated by reference in their entirety.

BACKGROUND

1. Field

The disclosure relates to a dishwasher. More particularly, the disclosure relates to a dishwasher including a basket movable in a vertical direction to form an accommodation space.

2. Description of Related Art

A dishwasher is a device for washing dishes by spraying high-pressure washing water onto the dishes. A general configuration of a dishwasher includes a machine room including a sump and a washing pump, a washing tub for washing, a basket for accommodating dishes, and a spray nozzle for spraying washing water, or the like, and the washing water sprayed from the spray nozzle by the washing pump washes an object to be washed.

Objects to be washed in the dishwasher include bulky kitchen utensils such as pots and frying pans in addition to cutlery including bowls, cups, spoons, forks, knives, or the like, and these objects to be washed are mounted at appropriate positions in a basket. Therefore, the basket of the dishwasher had to be able to efficiently accommodate various volumes of washing objects, and the basket had to have a structure in which the objects to be washed could be stably sprayed with washing water.

Since the height and width of the dishwasher are limited, there is a limit to the objects to be washed that can be accommodated. Accordingly, in a situation where there are many objects to be washed or a situation where a bulky object to be washed is required to be washed, there was inconvenience of operating the dishwasher multiple times. Therefore, there has been a technical need to accommodate a large amount and a bulky object to be washed in a limited space and to improve washing performance at the same time.

An object of the disclosure is to solve the problem described above, and it is an object of the disclosure to provide a dishwasher including a basket that is movable in a vertical direction to form an accommodation space.

SUMMARY

According to an embodiment of the disclosure, a dishwasher includes a main body provided with a washing tub inside, a first basket disposed inside the washing tub and configured to accommodate an object to be washed, and a second basket configured to accommodate the object to be washed, and move in a vertical direction between a first position disposed in a partial area inside the first basket, and a second position disposed above the partial area spaced apart from the first basket.

The first basket is composed of a plurality of wires at different intervals.

The plurality of wires include: a plurality of first wires disposed in the partial area where the second basket is disposed at a first interval, and a plurality of second wires disposed outside of the partial area and disposed at a second interval that is narrower than the first interval, wherein the plurality of first wires interferences less with a flow of washing water than the plurality of second wires.

The first basket is configured to, based on the second basket positioned in the first position, accommodate the object to be washed in another area, and based on the second basket being in the second position, accommodate the object to be washed in both the partial area and the another area, thereby accommodating an object to be washed with a relatively large washing area.

The first basket includes a plurality of tines formed on the plurality of second wires, among the plurality of wires, to support the object to be washed.

The second basket includes a plurality of ribs having an inclined shape to support the object to be washed.

The second basket includes a guide member coupled to the first basket and extending in the vertical direction, and the guide member includes a guide portion configured to guide a movement of the second basket, and a fixing unit configured to fix the second basket to the second position.

The second basket is configured to include a roller coupled to the guide member, and the guide member is formed in a shape of a rail for guiding the movement of the roller.

The guide member includes: a front guide member configured to support a front of the second basket, and a rear guide member configured to support a rear of the second basket.

The front guide member further includes a pivot guide portion configured to guide the second basket to be pivotable in an upper direction from the fixing portion at the second position.

The second basket includes a support wire disposed on one side of the second basket to support the object to be washed and prevent separation.

The support wire includes: a first support wire positioned on a rear side of the second basket, and a second support wire positioned on left and right sides of the second basket.

The support wire fixed to the first basket and extends in the vertical direction.

The dishwasher further comprises: a main spray nozzle configured to spray washing water into the first basket, a duct configured to supply washing water to the main spray nozzle and an additional spray nozzle configured to spray washing water to a position where the second basket is fixed on an upper portion.

The duct is configured to include a docking hole that is opened and closed by a docking of the additional spray nozzle, and the additional spray nozzle is fixed to the second basket and docked in the docking hole based on the second basket moving to the second position.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
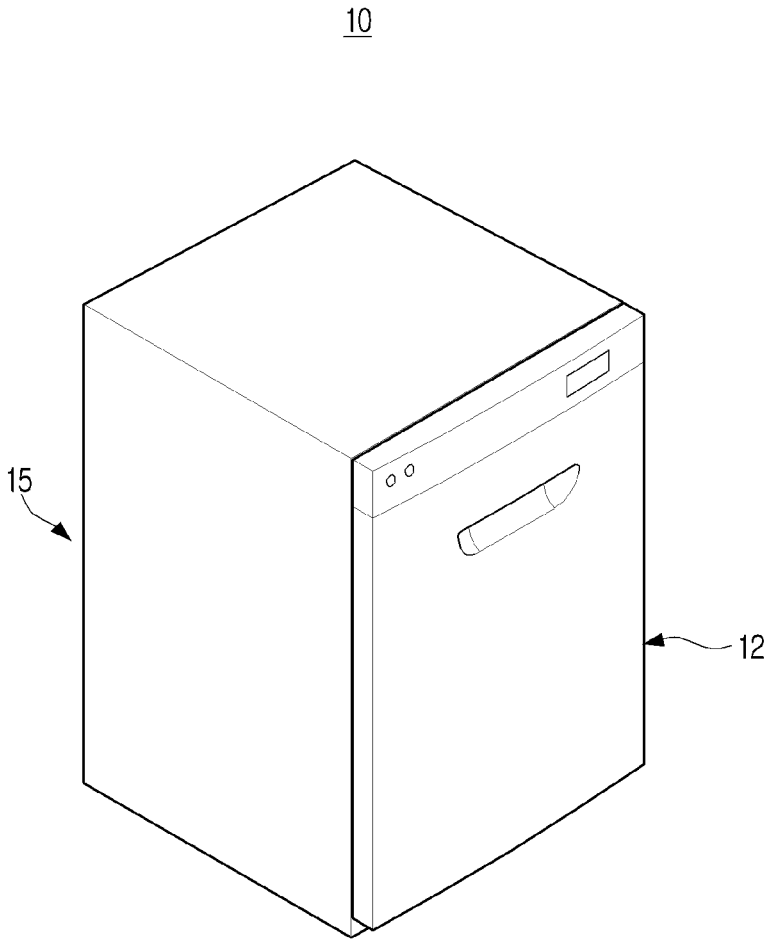
FIG. 1 is a perspective view illustrating a dishwasher according to an embodiment.

FIGS. 1 through 6B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

In the following description, same drawing reference numerals are used for the same elements even in different drawings. In the following description, well-known functions or constructions are not described in detail since they would obscure the invention in unnecessary detail. Further, dimensions of various elements in the accompanying drawings may be arbitrarily increased or decreased for assisting in a comprehensive understanding.

The terms used in the disclosure and the claims are general terms selected in consideration of the functions of the various example embodiments of the disclosure. However, such terms may be varied depending on an intention of those skilled in the art, a legal or technical interpretation, an emergence of a new technology, and the like. Also, there may be some terms arbitrarily selected by an applicant. Such terms may be construed according to meanings defined in the present specification and may also be construed based on general contents of the present specification and a typical technical concept in the art unless the terms are not specifically defined.

In the description of the disclosure, the order of each operation should be understood as non-limiting unless a preceding operation must be logically and temporally performed before a subsequent operation. In other words, except for the exceptional cases described above, even if the process described as the subsequent operation is performed before the process described as the preceding operation, an essence of the disclosure is not affected, and the scope of rights should also be defined regardless of the order of the operations.

As used herein, the terms such as "have", "may have", "include", "may include", or the like may indicate the presence of the corresponding characteristic (e.g., a numerical value, function, operation, or component such as a part), and does not exclude the presence of an additional characteristic.

The terms such as "first," "second," and so on may be used to describe a variety of elements, but the elements should not be limited by these terms. The terms are only used to differentiate one component from other components. For example, the 'first' component may be named the 'second' component, and vice versa, without departing from the scope of the disclosure.

In addition, the terms such as "outer peripheral surface", "inner peripheral surface", "top surface", "bottom surface", "side surface", "left", "right", "top", "bottom", "area", or the like used in the disclosure are defined based on figures, and the shape and position of each component are not limited by this term.

In addition, since the disclosure describes components necessary for a description of each embodiment of the disclosure, the disclosure is not necessarily limited thereto. Accordingly, some components may be changed or omitted, and other components may be added. In addition, they may be distributed and arranged in different independent devices.

Furthermore, although embodiments of the disclosure will be described in detail below with reference to the accompanying drawings and the contents described in the accompanying drawings, the disclosure is not restricted or limited by the embodiments.

Hereinafter, the disclosure will be described in more detail with reference to FIGS. 1 to 6B.

FIG. 1 is a perspective view illustrating a dishwasher 10 according to an embodiment of the disclosure.

Referring to FIG. 1, the dishwasher 10 may include a main body 15 forming an exterior and a door 12 for opening and closing the inside of the body 15.

The dishwasher 10 is a device for washing by spraying washing water on an object to be washed such as dishes, or the like, and may be classified into various types according to the structure and arrangement method of the main body 15. Types of the dishwasher 10 may include a built-in method in which a part of a furniture cabinet, which is an external support, is separated and installed in an empty space, a free-standing method that can be independently disposed, a counter top method placed on top counters such as furniture cabinets, an in-sink method that is manufactured and installed integrally with the dishwasher 10, or the like.

The dishwasher 10 shown in FIG. is a built-in type dishwasher 10 generally used for home use, but the dishwasher 10 including a basket 100 of the disclosure is not limited thereto, and may be applied to the basket 100 of the other types of dishwashers 10.

The door 12 has a structure that is rotatably installed on a front side of the main body 15, and a control device for the user to control the dishwasher 10 may be provided on the upper portion of the door 12, and the user may easily open and close the door 12 and operate the dishwasher 10. A washing tub 20 may be provided inside the door 12.

Figure 2:
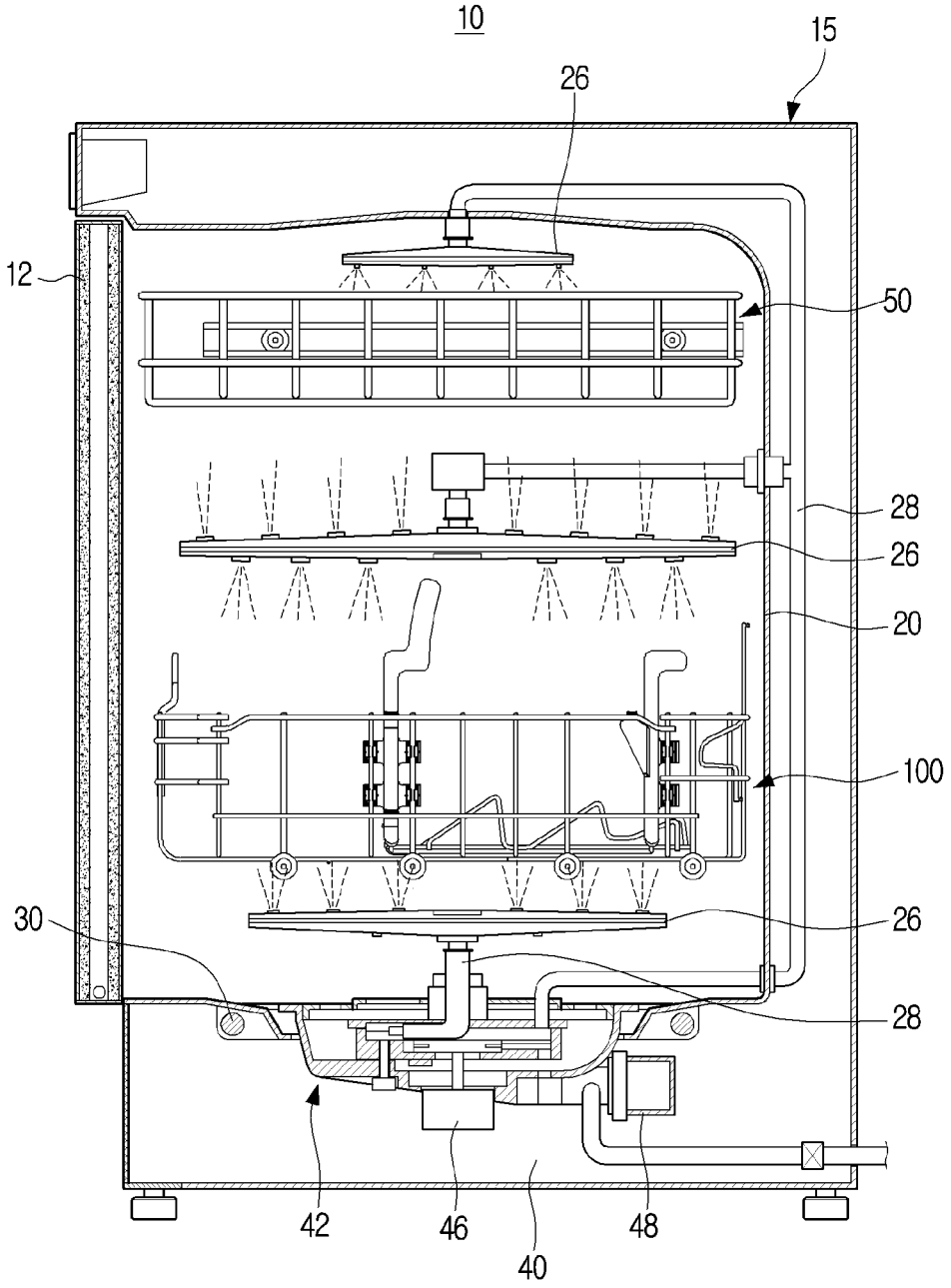
FIG. 2 is a side cross-sectional view illustrating a dishwasher according to an embodiment.

FIG. 2 is a side cross-sectional view of the dishwasher 10 according to an embodiment of the disclosure.

Referring to FIG. 2, the dishwasher 10 may include a washing tub 20, a machine room 40, and baskets 50 and 100.

The baskets 50 and 100 may be respectively disposed at the upper end and lower end of the washing tub 20. The baskets 50 and 100 is to support and accommodate objects to be washed, and may be composed of a frame, a plurality of racks, a plurality of wires, or the like, and may be referred to as a rack assembly according to a structure.

According to an arrangement position of the baskets 50 and 100, it may be divided into an upper basket 50 and a lower basket 100. Since an injection pressure of a spray nozzle 26 located close to the machine room 40 is stronger, a washing performance of the lower end of the washing tub 20 may be relatively good in the structure in which the machine room 40 is formed at the lower end of the washing tub 20. Accordingly, a space of the lower end of the dishwasher 10 is often larger than that of the upper end. Hereinafter, in consideration of an effect of an expansion of an accommodating space, the lower basket 100 will be described as the basis for convenience, but the upper basket 50 may have the same structure as the lower basket 100.

The washing tub 20 is a space provided inside the main body 15, and the washing tub 20 may include a plurality of baskets 50 and 100 in which dishes to be washed are mounted, and a plurality of spray nozzles 26.

The spray nozzle 26 may be provided on an upper portion of the upper basket 50 located at the uppermost side and be disposed between the upper spray nozzle 26 for spraying washing water, a middle spray nozzle 26 disposed between the upper basket 50 and the lower basket 100 to spray the washing water into each of the baskets 50 and 100, and the lower spray nozzle 26 for spraying washing water from the lower portion to the lower basket 100. In addition, although not shown in FIG. 2, as will be described in detail below with reference to FIG. 5, the dishwasher 10 of the disclosure may further include an additional spray nozzle 140, and the spray nozzle 26 described above may be referred to as a main spray nozzle 26 in order to distinguish the nozzles.

The spray nozzle 26 may be connected to a sump 42 by a duct 28 to receive washing water. The spray nozzle 26 may have a structure for spraying the washing water in various directions at a fixed position, or may rotate and evenly spray the washing water into the plurality of baskets 50 and 100.

A heater 30 for heating the washing water may be provided on a bottom surface of the washing tub 20, and a machine room 40 may be provided under the washing tub 20.

The sump 42 may be provided in the machine room 40 to collect and pump the washing water supplied into the washing tub 20 to move the washing water to the spray nozzle 26.

In addition, a plurality of passages and a circulation pump 46 for pumping water to the plurality of passages are provided in the sump 42, and a drain pump 48 for discharging contaminated washing water to the outside through a drain pipe may be provided on one side of the sump 42.

Hereinafter, an operation process of the dishwasher 10 configured as described above will be described.

When power is applied while an object to be washed is stored in the baskets 50 and 100 inside the washing tub 20, washing water required for washing may start to be supplied into the washing tub 20 through a washing water supply hole.

After the washing water supplied into the washing tub 20 may be collected into the sump 42 provided at the bottom of the washing tub 20, a washing process may be proceeded by supplying the washing water collected by a pumping action of an internal circulation pump 46 of the sump 42 to the spray nozzle 26 through the duct 28, and spraying the washing water at high pressure to the objects to be washed stored in the respective baskets 50 and 100.

When the washing process is completed, not only the washing water but also the contaminants on the objects to be washed are washed by the washing water and collected in the sump 42, such that the washing water containing the contaminants may be discharged to the outside through a drain pipe according to an operation of the drain pump 48.

When the washing water containing contaminants is discharged to the outside, clean washing water may be collected again into the sump 42 through a washing water supply hole, and the washing water may be sprayed to the objects to be washed at high pressure through each spray nozzle 26 in the same manner as the washing process, thereby processing a rinsing cycle.

When the rinsing cycle is completed, a drying cycle may be performed, and in the drying cycle, a heater 30 may be driven such that a high-temperature washing water may be sprayed on the objects to be washed and the washing water may be evaporated and dried together with the washing water remaining in the process of vaporizing the high-temperature washing water. Alternatively, high-pressure hot air may be sprayed in the drying cycle. When drying is completed, the washing process may be terminated.

Figure 3A:
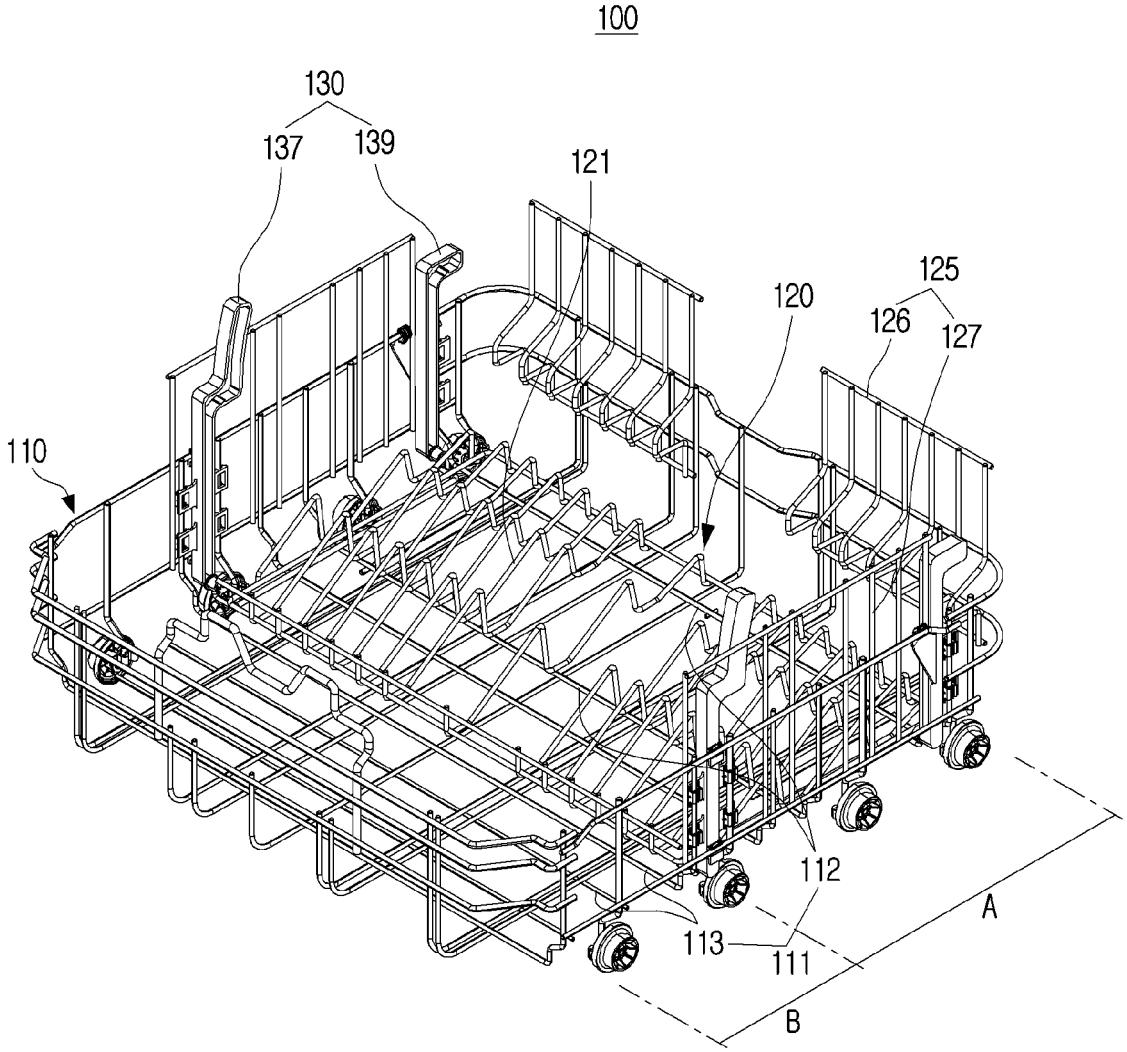
FIGS. 3A and 3B are perspective views illustrating a first basket and a second basket according to an embodiment.
Figure 3B:
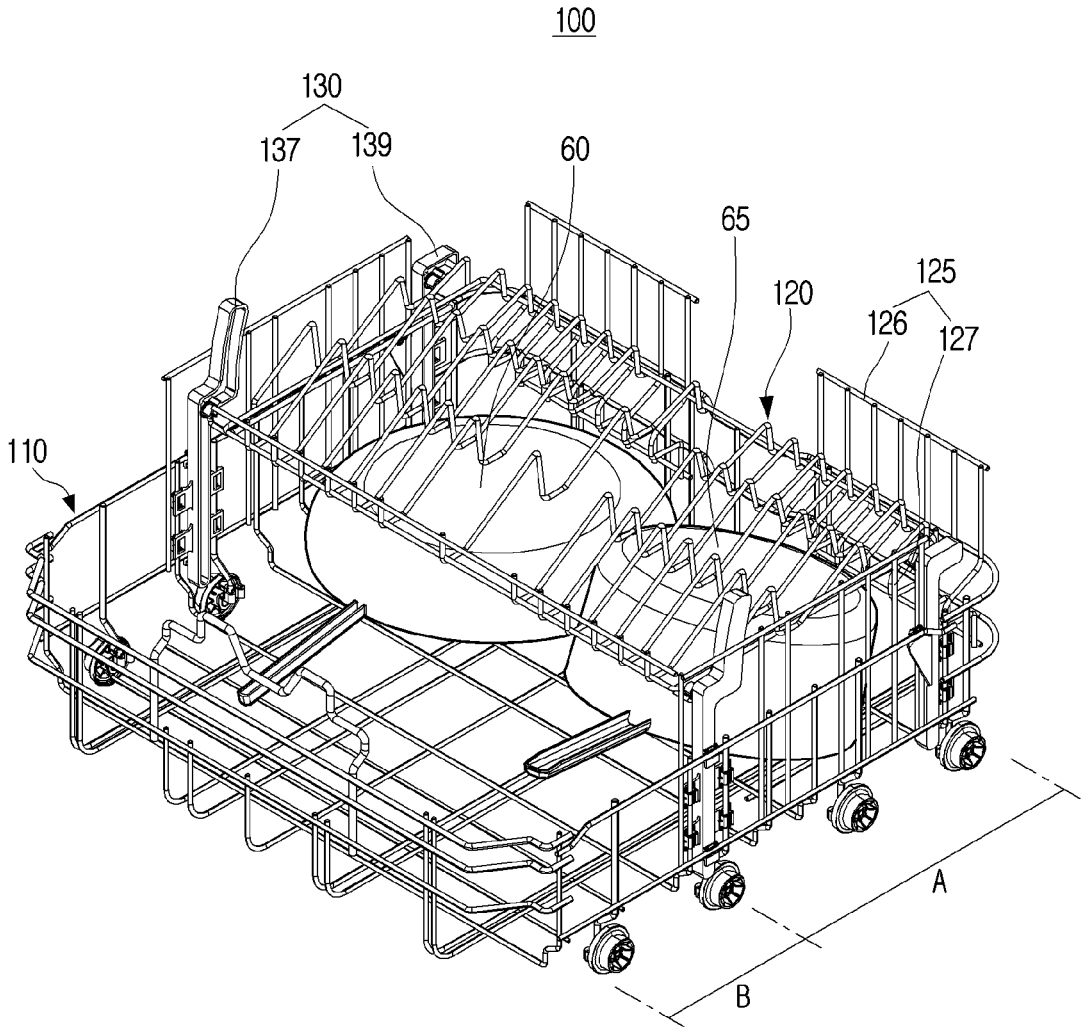

FIGS. 3A and 3B are perspective views of a first basket 110 and a second basket 120 according to an embodiment of the disclosure.

Referring to FIG. 3A, the basket 100 of the dishwasher 10 may include a first basket 110 and a second basket 120.

The first basket 110 may be disposed inside the washing tub 20 to accommodate an object to be washed. The first basket 110 may accommodate the object to be washed therein and may support the object to be washed such that the washing water sprayed from the spray nozzle 26 is well aimed at the object to be washed. Since a plurality of wheels are included on both sides of the first basket 110, the user may easily move the first basket 110 from a guide rail of the washing tub 20.

The first basket 110 may be formed of a frame in which at least a portion of the bottom surface is open, forming an outer periphery, and the frame may have a structure in which a plurality of wires 111 are spaced apart and combined. Particularly, on a bottom surface of the first basket 110, the plurality of wires 111 are spaced apart from each other in parallel to support the object to be washed and to pass washing water into the spaced space.

The main spray nozzle 26 located at the bottom and/or top of the first basket 110 may spray washing water toward the object to be washed accommodated in the first basket 110, and the sprayed washing water may be discharged downward through the bottom surface of the first basket 110. Therefore, since the plurality of wires 111 on the bottom surface of the first basket 110 may become obstacles for spraying and discharging the washing water, the smaller an area occupied by the plurality of wires 111 is, the more advantageous a movement of the washing water is, and thus cleaning performance may be improved. Therefore, the lower end of the first basket 110 may be formed of a minimum number of wires 111 for supporting the object to be washed.

The second basket 120 may be movable in a vertical direction and may accommodate an object to be washed. The second basket 120 may be disposed in a partial area of an interior of the first basket 110, may have a smaller volume than the first basket 110, and may be placed parallel to the first basket 110 on the bottom surface of the first basket 110.

The second basket 120, like the first basket 110, may accommodate an object to be washed therein and introduce and discharge washing water, such that the second basket 120 may be made of the same or similar structure and material as the first basket 110, and may be composed of a plurality of wires 111.

The second basket 120 may be composed of a plurality of ribs 121 having an inclined shape to support the object to be washed. The plurality of ribs 121 may be formed of the plurality of wires 111. The plurality of ribs 121 may be fixed so as not to be shaken or moved during washing by mounting the object to be washed at an angle. The plurality of ribs 121 may be effective in supporting an object to be washed such as a bowl having a concave shape. An angle of an inclination may be formed to correspond to a spraying direction of the additional spray nozzle 140 to be described below with reference to FIGS. 6A and 6B.

Although not shown in the figures, the second basket 120 may include a plurality of tines and may support dishes such as plates in an upright state. In this case, a support wire 125 may also have a structure for supporting an object to be mounted, and a spraying direction of the additional spray nozzle 140 may be changed to correspond to the mounting structure of the mounting target.

The second basket 120 may include the support wire 125 disposed on one side of the second basket 120 to support an object to be washed and prevent separation. The support wire 125 may include a plurality of first support wires 126 positioned on a rear side of the second basket 120 and a second support wire 127 positioned on both left and right sides of the second basket 120.

As shown in FIG. 3A, the support wire 127 may be fixed to the first basket 110 and may have a shape extending in a vertical direction, or, although not shown in the figures, a side frame of the second basket 120 may have a shape extending in the vertical direction.

An extended height of the support wire 125 may be higher than a height at which the second basket 120 moves in the vertical direction. The support wire 125 may prevent the object to be washed of the second basket 120 from falling downward when the second basket 120 is located on the upper portion and is being washed. As the support wire 125 is formed on both sides and the rear side, a front portion of the second basket 120 may include a bump structure of the frame to prevent separation of the object to be washed.

Referring to FIG. 3B, the second basket 120 may move up and down inside the first basket 110.

The second basket 120 may be movable in the vertical direction between a first position and a second position by a guide member 130 located on a side frame of the first basket 110 and may be fixed at the second position. The movement in the vertical direction may include not only movement of 90 degrees from a horizontal direction, but all movement moving upward from the horizontal direction. In other words, the movement of inclined straight line, curved line, or broken line shape may also be included in the movement in the vertical direction. A movement of the guide member 130 and the second basket 120 will be described below in detail with reference to FIGS. 4A to 4B.

Due to the movement of the second basket 120, the first basket 110 may have a variable accommodation space. For convenience of description, the first basket 110 may be divided into a partial area A in which the second basket 120 is disposed and the other area B which is an external area excluding this area. In addition, the plurality of wires 111 may include a plurality of first wires 112 disposed in the partial area A, and a plurality of wires 111 disposed in the other area B may include a plurality of second wires 113.

In a state in which the second basket 120 is positioned at the first position, which is a partial area inside the first basket, an object to be washed may be mounted on the second basket 120 corresponding to the partial area of the first basket 110. Therefore, in this state, the object to be washed may be accommodated in the other area B of the first basket 110 and the second basket 120.

In a state in which the second basket 120 is spaced apart from the first basket 110 and positioned at the second position disposed above the partial area A, the first basket 110 and the second basket 120 may be spaced apart from each other, and a space for accommodating dishes may be formed between the partial area A of the first basket 110 and the second basket 120. Therefore, in this state, the object to be washed may be accommodated in both the partial area A and the other area B of the first basket 110 and the second basket 120. Therefore, the first basket 110 may have a relatively large washing area and accommodate a bulky object to be washed.

The dishwasher 10 of the disclosure may increase an efficiency of space utilization by moving the second basket 120. Particularly, as shown in FIG. 3B, when the first basket 110 accommodates a relatively large pan 60, a pot 65, etc. among the objects to be washed, the first basket 110 may have a limit in accommodating other cleaning objects. However, in the dishwasher 10 of the disclosure, the second basket 120 may move upward and be fixed at the second position, such that the second basket 120 may additionally accommodate dishes and the like.

Some of the plurality of wires 111 may be spaced apart from the other plurality of wires 111 at different intervals. Specifically, a spacing between the plurality of first wires 112 and the plurality of second wires 113 may be different, and the plurality of second wires 113 may be disposed at a narrower interval than the plurality of first wires 112.

In the dishwasher 10, if the object to be washed moves away or moves during washing, washing water may not be properly delivered to the object to be washed and may interfere with washing away foreign substances in the washing water. Therefore, the first basket 110 should include fixing portions such as a plurality of wires 111 and a plurality of tines in order to fix the object to be washed, but if a volume occupied by the fixing portion increases, it may become an obstacle to the movement of washing water as described above, it may improve, by minimizing this, washing performance and efficiency.

In the first basket 110, in some areas where the plurality of first wires 112 are located, when the second basket 120 is at the lower portion, the object to be washed may be accommodated and supported in the second basket 120, and when the second basket 120 is located at the upper portion, the pan 60, the pot 65, etc. may mainly accommodate and support a bulky object to be washed. Therefore, the plurality of first wire 112 may be formed wider at the arrangement intervals than the plurality of second wire 113, and the partial area A has less interference with a flow of washing water than other area B, and thus it may be possible to accommodate a relatively bulky object to be washed in the accommodation space, while at the same time effectively delivering washing water and improving washing performance.

The first basket 110 may include the plurality of tines supporting the object to be washed, and the plurality of tines may be selectively formed only on the plurality of second wires 113 among the plurality of wires 111. By partially forming the plurality of tines, the other area B may effectively support the object to be washed by the plurality of tines, and the partial area A may reduce obstacles in passing the washing water.

Through the structure of the first basket 110 and the second basket 120 described above, the second basket 120 may accommodate dishes having a concave shape, and the other area B may accommodate a plate, cutlery, etc. by the plurality of tines, and the partial area A may accommodate the pan 60, the pot 65, etc., and thus the first basket 110 has an advantage that it can accommodate various types and shapes of dishes.

Therefore, the dishwasher 10 of the disclosure may accommodate a bulky object to be washed, increase space efficiency by moving the second basket 120 and by the structure of the first basket 110 and the second basket 120, and increase space efficiency. Also, as the spacing between the plurality of wires 111 of the first basket 110 is changed, the washing performance of the bulky object to be washed may be improved.

FIGS. 4A to 4D are side views illustrating a movement of the second basket 120 according to an embodiment of the disclosure.

Figure 4A:
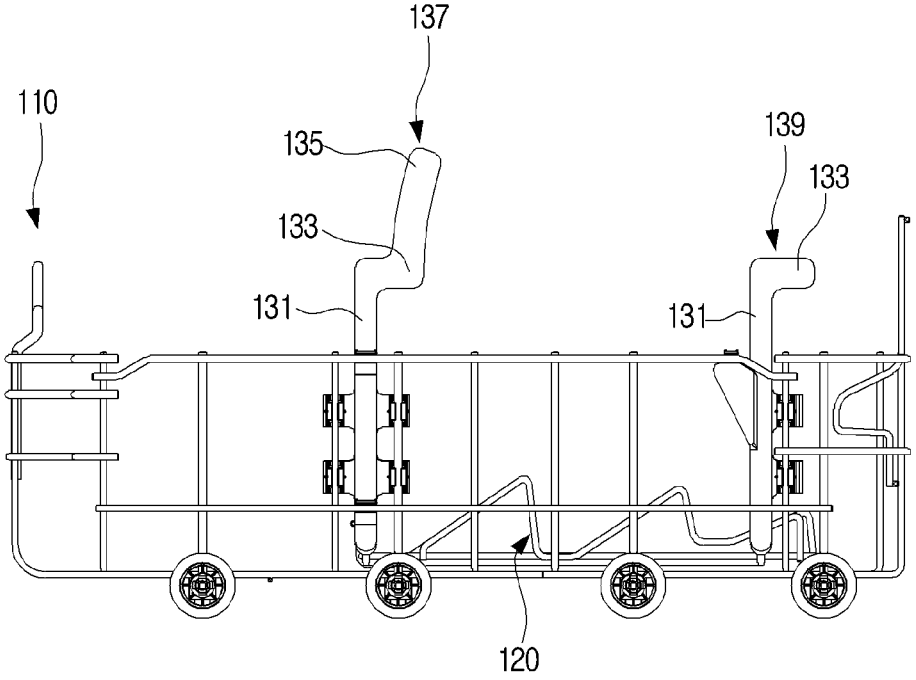
FIGS. 4A to 4D are side views illustrating a movement of a second basket according to an embodiment.

Referring to FIG. 4A, the second basket 120 may include a guide member 130.

The guide member 130 may be coupled to the first basket 110 and have a shape extending in the vertical direction. The second basket 120 may include a coupling member coupled to the guide member 130 to be guided along a predetermined movement path. The coupling member of the second basket 120 may be formed as a protrusion or a receiving portion corresponding to the structure of the guide member 130, or the guide member 130 may be formed in a rail shape, such that the second basket 120 may include a roller coupled to the guide member 130 to be guided by the guide member 130. The second basket 120 may be moved smoothly by the roller, and the user may move the second basket 120 intuitively and easily.

The guide member 130 may be coupled to a side surface of the first basket 110 to position the second basket 120 inside the first basket 110. The guide member 130 may form a single body, or the second basket 120 may include a plurality of guide members 130. A front guide member 137 supporting the front of the second basket 120 and a rear guide member 139 supporting the rear of the second basket 120 may each be coupled to the first basket 110.

Figure 4B:
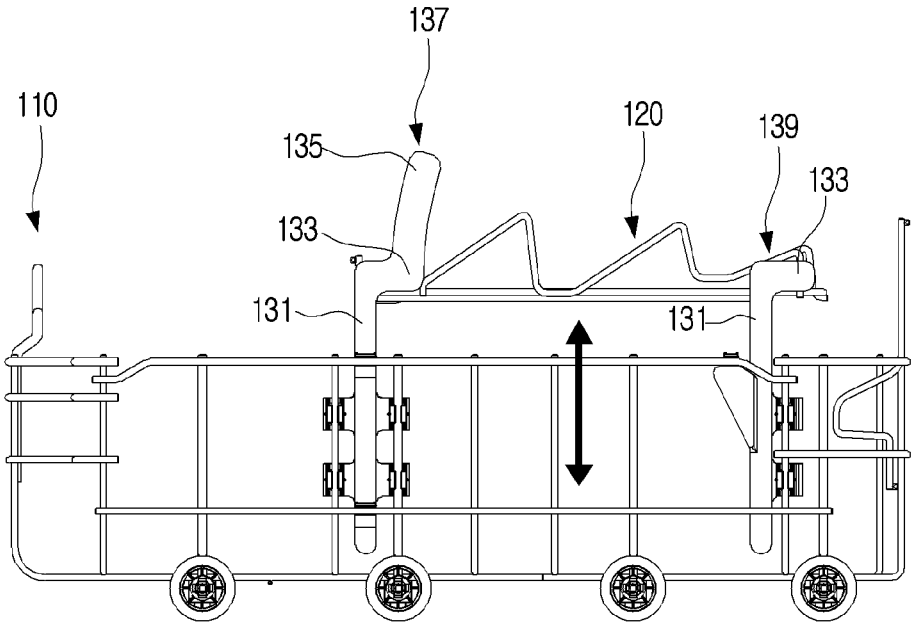

Referring to FIG. 4B, the guide member 130 may include a guide portion 131.

The guide portion 131 may guide a movement of the second basket 120. A starting point of the guide portion 131 may be set to a position where at least a portion of the bottom surface of the first basket 110 and the bottom surface of the second basket 120 contact each other. The second basket 120 may be in contact with the upper surface of the partial area A of the first basket 110 to accommodate and support the object to be washed. At the starting point of the guide portion 131, since the second basket 120 is fixed to the lower end by its own weight, a separate fixing portion may be omitted, or the second basket 120 may be fixed so as not to be pushed by the washing water by including a separate locking structure.

The guide portion 131 may have a linear shape to guide the second basket 120 in a straight direction, but is not limited thereto, and may have an oblique, curved, or broken line shape.

An end point of the guide portion 131 may be formed adjacent to a height at which the second basket 120 is fixed thereto. There is no limit to a movement range of the second basket 120 between the starting point and the ending point of the guide portion 131, but it may have a height equal to or higher than the upper surface of the first basket 110 by considering that a spatial range of the washing tub 20 is limited, the upper surface of the first basket 110 and the same or may have a high degree of height, or it may be designed to be higher than the height of the pan 60 or the pot 65 generally used at home by considering the space between the first basket 110 and the second basket 120.

Figure 4C:
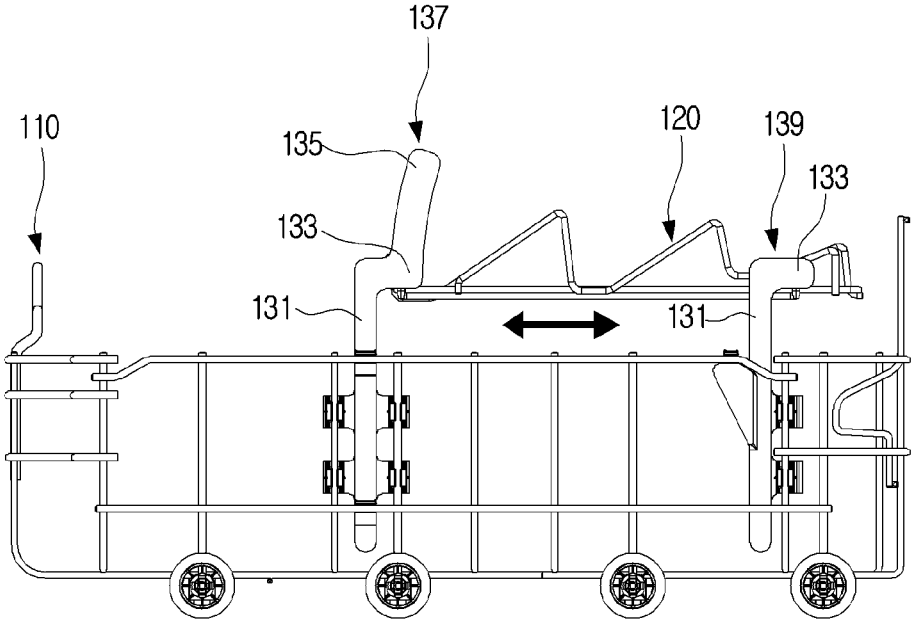

Referring to FIG. 4C, the guide member 130 may include a fixing portion 133.

The fixing portion 133 may fix the second basket 120 at the second position. The fixing portion 133 may be connected to an end point of the guide portion 131 such that the second basket 120 may be separated from the guide portion 131 to be fixed. A method of fixing may be various. For example, the second basket 120 may further include a separate fixing portion, the second basket 120 may include a fixing groove, or the fixing portion 133 of the guide member 130 may include a magnet to attract and fix the fixing portion of the second basket 120 having magnetism.

The fixing portion 133 may have a shape extending in the horizontal direction from the guide portion 131 as shown in FIG. 4C or may have a structure inclined downward from the horizontal direction. In this case, the second basket 120 may be pushed back to escape from the guide portion 131 and be fixed to the fixing portion 133.

Figure 4D:
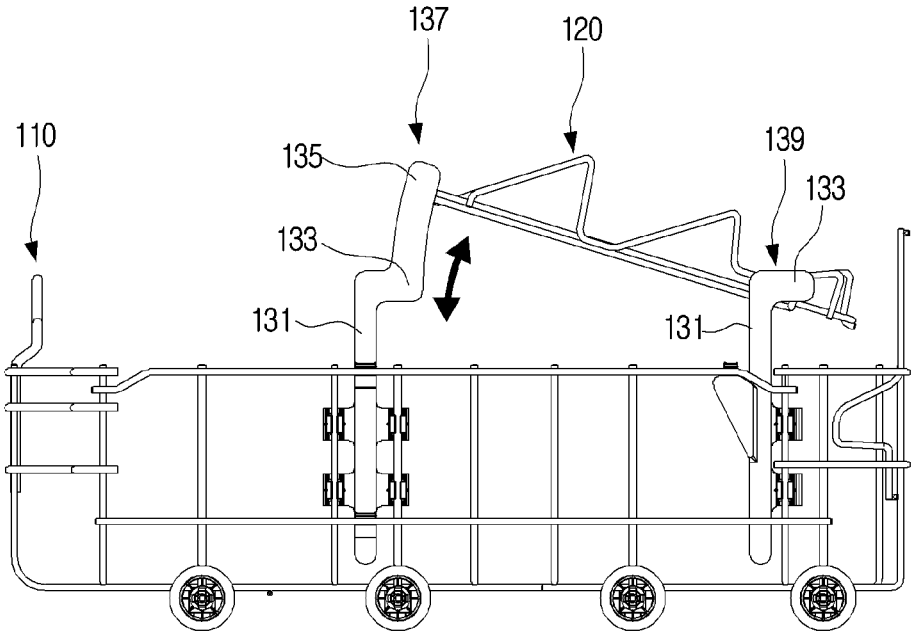

Referring to FIG. 4D, the guide member 130 may include a pivot guide portion 135.

The pivot guide portion 135 may guide the second basket 120 to be pivotable from the fixing portion 133 in the upper direction. The pivot guide portion 135 may have a shape in which the guide portion 131 extends upward from the fixing portion 133 within a predetermined angle and range.

The pivot guide portion 135 may be formed on a front guide member 137 of the guide member 130. In this case, the front side of the second basket 120 may be pivoted by the pivot guide portion 135 while the rear side may be fixed to the fixing portion 133. When the first basket 110 and the second basket 120 are spaced apart and a bulky pan 60 or pot 65 is put on a partial area A of the first basket 110, the front of the second basket 120 may be pivoted, and the object to be washed may be easily mounted on the accommodation space without being caught in the second basket 120.

Figure 5:
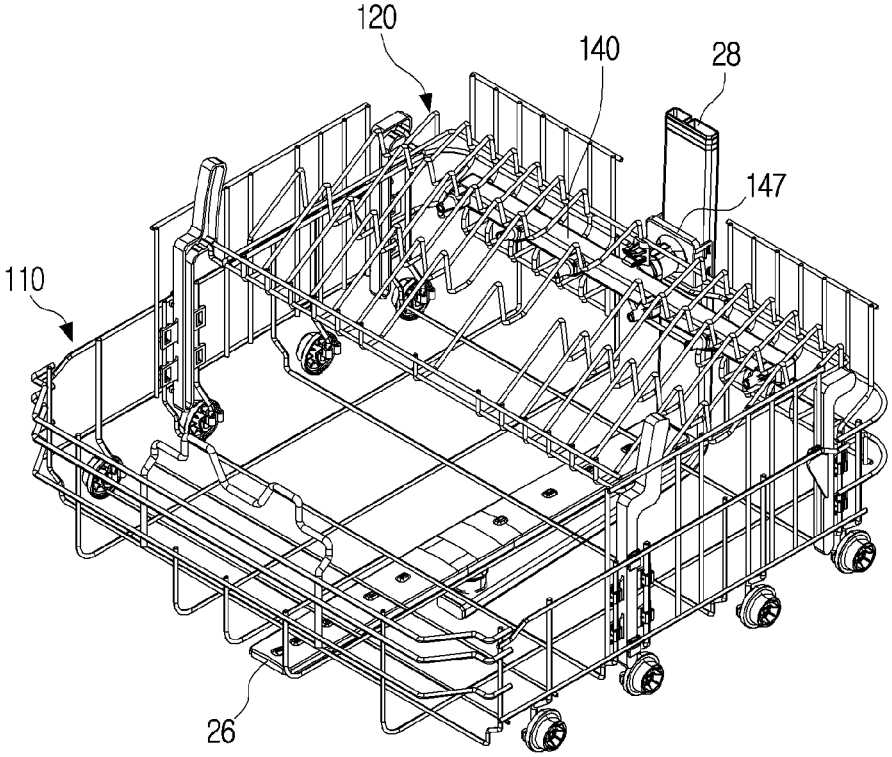
FIG. 5 is a perspective view illustrating a first basket and a second basket according to an embodiment.

FIG. 5 is a perspective view illustrating the first basket 110 and the second basket 120 according to an embodiment of the disclosure.

Referring to FIG. 5, the dishwasher 10 may include an additional spray nozzle 140.

The additional spray nozzle 140 may have the second basket 120 positioned on the rear surface to spray the washing water to the object to be washed of the second basket 120. For example, when the second basket 120 is located at the upper portion, the additional spray nozzle 140 may spray the washing water to the second basket 120, and when the second basket 120 is located at the lower portion, the main spray nozzle 26 located on the upper or lower portion of the first basket 110 may spray the washing water into the second basket 120. The duct 28 may be connected to the main spray nozzle 26 and the additional spray nozzle 140 to supply washing water.

The additional spray nozzle 140 may have a structure fixed to the duct 28, or the additional spray nozzle 140 may include a docking member 141 to be detachable from a docking hole 147 of the duct 28.

The additional spray nozzle 140 may spray the washing water to the object to be washed of the second basket 120 only when the second basket 120 is located on the upper portion. When the second basket 120 is positioned at the lower portion, the supply of washing water may be interrupted by interlocking with the movement of the second basket 120, or the additional spray nozzle 140 may be separated from the docking hole 147.

The docking hole 147 may be opened and closed by docking of the additional spray nozzle 140. The docking hole 147, by including a door, may maintain the door closed in a state in which the additional spray nozzle 140 is not docked, such that the washing water does not pass, and when the additional spray nozzle 140 is docked, the door is opened and the docking hole 147 may transmit the washing water to the additional spray nozzle 140.

The opening and closing structure of the docking hole 147 may be implemented in various ways. The door of the docking hole 147 has a structure divided into a plurality of zones, the additional spray nozzle 140 is docked, the docking member 141 pushes the door to open the door, and the washing water may be transmitted through the docking hole 147. Alternatively, the docking hole 147 may include a plurality of elastic protrusions therein, and the plurality of elastic protrusions mays serve to prevent the washing water from flowing into the docking hole 147, and when the additional spray nozzle 140 is docked, the docking member 141 may form a space through which the washing water can pass by pushing the plurality of elastic protrusions.

The additional spray nozzle 140 may be coupled to the second basket 120 and move together with the second basket 120. The fixing portion 133 of the guide member 130 has a structure for guiding the second basket 120 in a horizontal direction, and the additional spray nozzle 140 may move to the rear side together with the second basket 120, and when the second basket 120 is located at the end of the fixing portion 133, the docking member 141 of the additional spray nozzle 140 may be in contact with and connected to the docking portion. Even when the second basket 120 moves to the front and is separated from the fixing portion 133, the docking member 141 of the additional spray nozzle 140 may be separated from the docking hole 147 and the docking hole 147 may be closed. In this case, the user may dock or separate the additional spray nozzle 140 by only moving the second basket 120 without docking and releasing the additional spray nozzle 140.

When the second basket 120 is located at the upper portion, the bulky pan 60, pot 65, etc. may be accommodated in a space spaced apart between the first basket 110 and the second basket 120, and thus the lower main spray nozzle 26 may have a limitation in spraying the washing water to the object to be washed of the second basket 120. The additional spray nozzle 140 may be selectively docked only when the second basket 120 is positioned on the upper portion to spray the washing water, thereby improving washing performance.

The docking hole 147 may supply washing water to the additional spray nozzle 140 as needed, such that when the additional spray nozzle 140 is not docked, it may be possible to prevent a problem in which the washing water is lost and a spry pressure of the washing water is lowered, and the amount of water used may be reduced, thereby increasing washing efficiency and reducing water consumption by the docking hole 147 selectively opened and closed according to the position of the second basket 120.

Figure 6A:
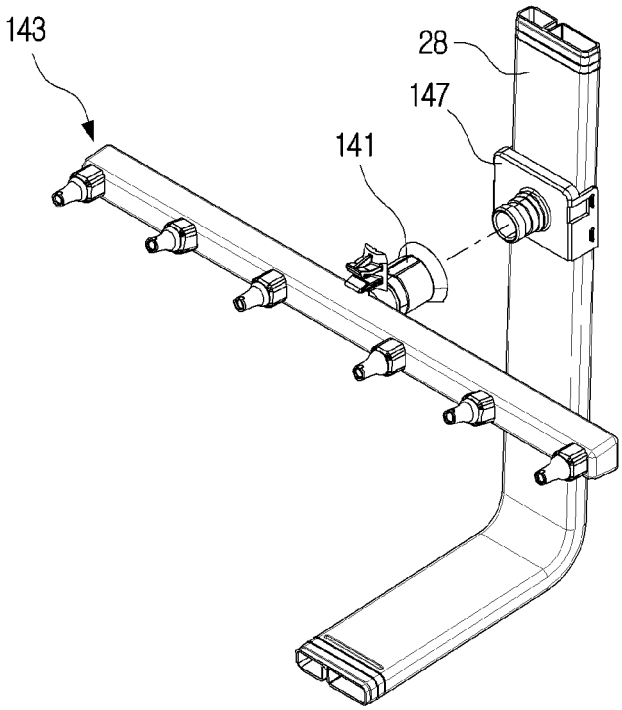
FIGS. 6A and 6B are exploded perspective views illustrating a coupling structure of an additional spray nozzle according to an embodiment.
Figure 6B:
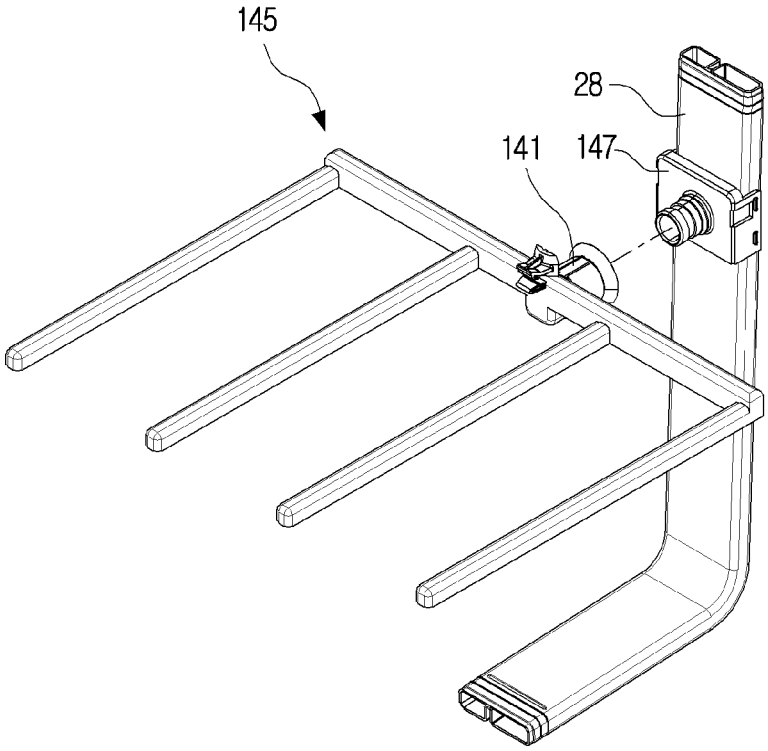

FIGS. 6A and 6B are exploded perspective views illustrating a coupling structure of the additional spray nozzle 140 according to an embodiment of the disclosure.

Referring to FIG. 6A, the additional spray nozzle 143 may spray the washing water in a direction inclined upward with respect to a horizontal direction.

The additional spray nozzle 143 may be docked in the docking hole 147 through the docking member 141 located at the rear side. The additional spray nozzle 143 may have a bar shape extending in a horizontal direction, and may spray washing water through a plurality of spray holes formed on the front surface.

In consideration of the angle at which the plurality of ribs 121 of the second basket 120 are inclined, the plurality of spray holes of the additional spray nozzle 143 may be inclined in a spraying direction of the nozzle to spray the washing water to an internal washing area of the object to be washed. When the object to be washed of the second basket 120 is supported to be inclined upward with respect to the horizontal direction, the additional spray nozzle 143 may spray the washing water in a direction inclined upward with respect to the horizontal direction, and the object to be washed mounted on the second basket 120 may be washed.

Referring to FIG. 6B, the additional spray nozzle 145 may spray the washing water in a vertical direction.

The additional spray nozzle 145 may have a structure including a plurality of rods in which a plurality of spray holes is formed. The plurality of rods may be disposed parallel to each other and may spray the washing water in the vertical direction, respectively. Through this structure, washing water may be sprayed with a strong spray pressure even to an object to be washed from a relatively long distance, and as the plurality of spray holes of the additional spray nozzle 145 are widely distributed, a wider range may be washed.

Although not shown in the figures, the dishwasher 10 may include a lever for moving the second basket 120 and the additional spray nozzle 140, and the user may push and pull the lever with the second basket 120 to move the second basket 120 and the additional spray nozzle 140. Alternatively, a driving device may be controlled by a processor (not shown) of the dishwasher 10, including a driving device for moving the guide member 130 or opening and closing the docking hole 147.

Although the preferred exemplary embodiments of the disclosure have been disclosed for illustrative purposes, those skilled in the art will appreciate that various modifications, additions and substitutions are possible, without departing from the scope and spirit of the disclosure as disclosed in the accompanying claims. Accordingly, such modifications, additions and substitutions should also be understood to fall within the scope of the disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A dishwasher comprising:

a main body;

a washing tub provided inside the main body;

a first basket disposed inside the washing tub; and a second basket configured to:

move in a vertical direction between a first position disposed in a partial area inside the first basket, and a second position disposed above the partial area spaced apart from the first basket, wherein the second basket includes a guide member that is coupled to a side frame of the first basket and extends in the vertical direction, wherein, when the second basket is positioned at the first position, the second basket is parallel to the first basket and touches the bottom surface of the first basket, wherein, when the second basket is positioned at the first position, the first basket and the second basket are able to accommodate objects to be washed in another area, wherein, in a state in which the second basket is positioned at the second position, the second basket is spaced apart from a bottom surface of the first basket, the first basket and the second basket are parallel to each other, and the first basket and the second basket are able to accommodate objects to be washed in both the partial area and the another area, wherein the guide member includes:

a guide portion configured to guide a movement of the second basket, and a fixing unit configured to fix the second basket to the second position.

2. The dishwasher of claim 1, wherein the first basket is composed of a plurality of wires spaced apart at different intervals.

3. The dishwasher of claim 2, wherein:

the plurality of wires include:

a plurality of first wires disposed in the partial area where the second basket is disposed at a first interval, and a plurality of second wires disposed outside of the partial area and disposed at a second interval that is narrower than the first interval, and the plurality of first wires interferes less with a flow of washing water than the plurality of second wires.

4. The dishwasher of claim 3, wherein the first basket is configured to:

based on positioning the second basket in the second position, support an object to be washed in both the partial area and outside the partial area.

5. The dishwasher of claim 3, wherein the first basket includes a plurality of tines formed on the plurality of second wires, among the plurality of wires, to support the object to be washed.

6. The dishwasher of claim 1, wherein the second basket includes a plurality of ribs having an inclined shape to support the object to be washed.

7. The dishwasher of claim 1, wherein:

the second basket is configured to include a roller coupled to the guide member, and the guide member is formed in a shape of a rail for guiding the movement of the roller.

8. The dishwasher of claim 1, wherein the guide member includes:

a front guide member configured to support a front of the second basket, and a rear guide member configured to support a rear of the second basket.

9. The dishwasher of claim 8, wherein the front guide member further includes a pivot guide portion configured to guide the second basket to be pivotable in an upper direction from a fixing portion at the second position.

10. The dishwasher of claim 1, wherein the second basket includes a support wire disposed on one side of the second basket to support the object to be washed and prevent separation.

11. The dishwasher of claim 10, wherein the support wire includes:

a first support wire positioned on a rear side of the second basket, and a second support wire positioned on left and right sides of the second basket.

12. The dishwasher of claim 10, wherein the support wire is fixed to the first basket and extends in the vertical direction.

13. The dishwasher of claim 1, further comprising:

a main spray nozzle configured to spray washing water into the first basket;

a duct configured to supply washing water to the main spray nozzle; and an additional spray nozzle configured to spray washing water to a position where the second basket is fixed on an upper portion.

14. The dishwasher of claim 13, wherein:

the duct is configured to include a docking hole that is opened and closed by a docking of the additional spray nozzle, and the additional spray nozzle is fixed to the second basket and docked in the docking hole based on the second basket moving to the second position.

15. A dishwasher basket assembly, comprising:

a first basket, the first basket comprising:

a horizontal portion having four sides;

a vertical portion extending upwards from the four sides of the horizontal portion to define a perimeter of the first basket;

a pair of front guide members disposed on opposing sides of the perimeter of the first basket, and wherein each front guide member is disposed toward a front of the first basket; and a pair of rear guide members disposed on opposing sides of the perimeter of the first basket, wherein each rear guide member is disposed towards a rear of the first basket, and a second basket, the second basket comprising:

a horizontal portion, having a front end and a rear end, wherein the front end of the horizontal portion of the second basket is configured to move vertically within the front guide members between a first position and a second position, wherein the rear end of the horizontal portion of the second basket is configured to move vertically within the rear guide members between the first position and the second position, and wherein the horizontal portion of the second basket is parallel with the horizontal portion of the first basket in the first position.

16. The dishwasher basket assembly of claim 15, wherein front guide members of the pair of front guide members each comprise a pivot portion, and wherein rear guide members of the pair of rear guide members each comprise a rear fixing portion.

17. The dishwasher basket assembly of claim 16, wherein the front guide members of the pair of front guide members each comprise a front fixing portion.

18. The dishwasher basket assembly of claim 17, wherein the front end of the horizontal portion is configured to move upwards within the pivot portion of each front guide member of the pair of front guide members to a third position, and wherein in the third position, the horizontal portion of the second basket is angled relative to the horizontal portion of the first basket.

19. The dishwasher basket assembly of claim 15, wherein the second basket includes a plurality of ribs having an inclined shape to support an object to be washed.

* * * * *